US010474180B1

(12) United States Patent
Yang et al.

(10) Patent No.: US 10,474,180 B1
(45) Date of Patent: Nov. 12, 2019

(54) CURRENT BALANCE CIRCUIT

(71) Applicant: ASUS GLOBAL PTE. LTD., Singapore (SG)

(72) Inventors: Meng-Jie Yang, Singapore (SG); Zhao-Long Dong, Singapore (SG)

(73) Assignee: ASUS GLOBAL PTE. LTD., Singapore (SG)

( * ) Notice: Subject to any disclaimer, the term of this patent is extended or adjusted under 35 U.S.C. 154(b) by 0 days.

(21) Appl. No.: 16/383,298

(22) Filed: Apr. 12, 2019

(30) Foreign Application Priority Data

Apr. 23, 2018 (CN) ..... 2018 1 0366101

(51) Int. Cl.
*G05F 3/00* (2006.01)
*G05F 3/24* (2006.01)

(52) U.S. Cl.
CPC ..... *G05F 3/24* (2013.01)

(58) Field of Classification Search
CPC ..... G05F 3/24; G05B 9/02; H02J 1/10; H02J 3/006; H02J 3/38; H02J 17/122; H02J 2001/106
See application file for complete search history.

(56) References Cited

U.S. PATENT DOCUMENTS

2016/0149400 A1* 5/2016 Dickey ..... H02J 1/10 361/93.1
2016/0327917 A1 11/2016 Dickey et al.

FOREIGN PATENT DOCUMENTS

CN 102857099 B 12/2014

* cited by examiner

*Primary Examiner* — Adolf D Berhane
*Assistant Examiner* — Afework S Demisse
(74) *Attorney, Agent, or Firm* — McClure, Qualey & Rodack, LLP

(57) ABSTRACT

The disclosure discloses a current balance circuit, which comprises a current sensing unit, a reference unit and an adjusting unit. The current sensing unit is configured to receive a plurality of input currents flowing through a plurality of channels having different impedances, and generate a plurality of corresponding input voltages according to the plurality of input currents. The reference unit is coupled to the current sensing unit, and configured to distribute a plurality of setting voltages corresponding to a plurality of output ends according to an output current ratio related to the plurality of output ends and the plurality of input voltages. The adjusting unit is coupled to the current sensing unit and the reference unit, and configured to adjust the plurality of input currents according to the plurality of setting voltages and input voltages, and generate a plurality of output currents to prevent a channel from being overloaded.

10 Claims, 4 Drawing Sheets

CURRENT BALANCE CIRCUIT

CROSS-REFERENCE TO RELATED APPLICATION

This application claims the priority benefit of Chinese Application Serial No. 201810366101.9, filed on Apr. 23, 2018. The entirety of the above-mentioned patent application is hereby incorporated by reference herein and made a part of specification.

BACKGROUND OF THE INVENTION

Field of the Invention

The disclosure relates to a current balance circuit and, more particularly, to a current balance circuit controlling an input current on each channel.

Description of the Related Art

In many applications, a same input voltage is connected to a plurality of input interfaces through which a plurality of input currents respectively flows. The input current of each channel has a different maximum allowable current, and when the input current flowing through the channel is greater than the maximum allowable current, the channel would burn down.

In order to keep the input current within the maximum allowable current of each channel, it is necessary to set the input current of each channel respectively. However, the complexity of current distribution increases.

BRIEF SUMMARY OF THE INVENTION

The disclosure is related to a current balance circuit capable of effectively preventing a channel from being overloaded.

According to an aspect, a current balance circuit is provided. The current balance circuit comprises a current sensing unit, a reference unit and an adjusting unit. The current sensing unit is configured to receive a plurality of input currents flowing through a plurality of channels having different impedances, and generate a plurality of corresponding input voltages according to the plurality of input currents. The reference unit is coupled to the current sensing unit, and is configured to distribute a plurality of setting voltages corresponding to a plurality of output ends according to an output current ratio related to the plurality of output ends and the plurality of input voltages. The adjusting unit is coupled to the current sensing unit and the reference unit, and is configured to adjust the plurality of input currents according to the plurality of setting voltages and the plurality of input voltages, and generate a plurality of output currents to the plurality of output ends.

In some embodiments, the adjusting unit is further configured to control an opening degree of a plurality of linear switches according to the plurality of setting voltages and the plurality of input voltages. The adjusting unit is also configured to adjust the plurality of input currents according to the opening degree of the plurality of linear switches and generate the plurality of output currents.

In some embodiments, the current sensing unit comprises: a first resistor, a first amplifier circuit, a second resistor and a second amplifier circuit. A first end of the first resistor is configured to receive a first input current of the plurality of input currents. The first amplifier circuit is configured to amplify a voltage difference of two ends of the first resistor to generate a first input voltage of the plurality of input voltages. A first end of the second resistor is configured to receive a second input current of the plurality of input currents. The second amplifier circuit is configured to amplify a voltage difference of two ends of the second resistor to generate a second input voltage of the plurality of input voltages.

In some embodiments, the reference unit comprises an adder circuit, a first resistor, a second resistor, a third resistor and a fourth resistor. The plurality of input voltages is added by the adder circuit. A first end of the first resistor is coupled to the adder circuit. A first end of the second resistor is coupled to a second end of the first resistor and a first setting voltage of the plurality of setting voltages, and a second end of the second resistor is grounded. A first end of the third resistor is coupled to the adder circuit. A first end of the fourth resistor is coupled to a second end of the third resistor and a second setting voltage of the plurality of setting voltages, and a second end of the fourth resistor is grounded.

In some embodiments, a ratio of resistance values of the first resistor and of the second resistor and a ratio of resistance values of the third resistor and of the fourth resistor are related to the output current ratio.

In some embodiments, the adjusting unit comprises a first amplifier circuit, a first transistor, a second amplifier circuit and a second transistor. A positive input end of the first amplifier circuit is coupled to a first input voltage of the plurality of input voltages, and an inverted input end of the first amplifier circuit is coupled to a first setting voltage of the plurality of setting voltages. A source of the first transistor receives a first input current of the plurality of input currents, a gate of the first transistor is coupled to an output end of the first amplifier circuit, and a drain of the first transistor is configured to output a first output current of the plurality of output currents. A positive input end of the second amplifier circuit is coupled to a second input voltage of the plurality of input voltages, and an inverted input end of the second amplifier circuit is coupled to a second setting voltage of the plurality of setting voltages. A source of the second transistor is configured to receive the second input current of the plurality of input currents, a gate of the second transistor is coupled to an output end of the second amplifier circuit, and a drain of the second transistor is configured to output a second output current of the plurality of output currents.

In some embodiments, the first input voltage approaches the first setting voltage when the positive input end and the inverted input end of the first amplifier circuit achieve balance, and the second input voltage approaches the second setting voltage when the positive input end and the inverted input end of the second amplifier circuit achieve balance.

In some embodiments, the current balance circuit further comprises a voltage detection unit. The voltage detection unit is coupled to the adjusting unit and the current sensing unit, and is configured to control the plurality of input voltages from the current sensing unit to prevent the plurality of input voltages from exceeding a critical value.

In some embodiments, the voltage detection unit comprises an amplifier circuit, a first transistor, a first switch, a second transistor and a second switch. A positive input end of the amplifier circuit is configured to receive a first input current of the plurality of input currents, and an inverted input end of the amplifier circuit is configured to receive a second input current of the plurality of input currents. A source of the first transistor is grounded, a gate of the first transistor is coupled to an output end of the amplifier circuit, and a drain of the first transistor is coupled to an operating voltage. A first end of the first switch is coupled to a first input voltage of the plurality of input voltages, and a second end of the first switch is coupled to the drain of the first transistor. A source of the second transistor is grounded, and a gate of the second transistor is coupled to the drain of the first transistor and a second end of the first switch. A first end of the second switch is coupled to a second input voltage of the plurality of input voltages, and a second end of the second switch is coupled to a drain of the second transistor.

In some embodiments, the second switch is on for pulling down the second input voltage, in response to the first input current is greater than the second input current, and the first switch is on for pulling down the first input voltage, in response to the first input current is less than the second input current.

By the above-mentioned methods of the disclosure, the input currents are distributed to each input interface according to the output current ratio of the current on each channel and the plurality of input voltages while being kept within maximum allowable currents.

The disclosure aims to provide a simplified abstract of the disclosure, so as to provide readers a basic understanding of the disclosure, and is not intended to point out important components of an embodiment of the disclosure or define a scope of the disclosure.

BRIEF DESCRIPTION OF THE DRAWINGS

To make the foregoing and other objectives, features, advantages, and embodiments of the disclosure more comprehensible, descriptions of the accompanying drawings are as follows.

DETAILED DESCRIPTION OF THE EMBODIMENTS

To make the description of the disclosure more thorough and complete, reference may be made to the accompanying drawings and the various embodiments described below. On the other hand, well-known components are not described in the embodiments to avoid unnecessarily limiting the disclosure.

As used herein, "coupled" or "connected" may mean that two or more components are in direct physical or electrical contact with each other, or are in indirect physical or electrical contact with each other, while "coupled" or "connected" may also mean that two or more components cooperate or interact with each other.

The disclosure is applied to control currents on different channels having different impedances, such that the current on each channel does not exceed a magnitude of a maximum current that the channel is able to bear, and a magnitude of a current in each channel is distributed according to a current magnitude ratio needed by each channel.

Figure 1:
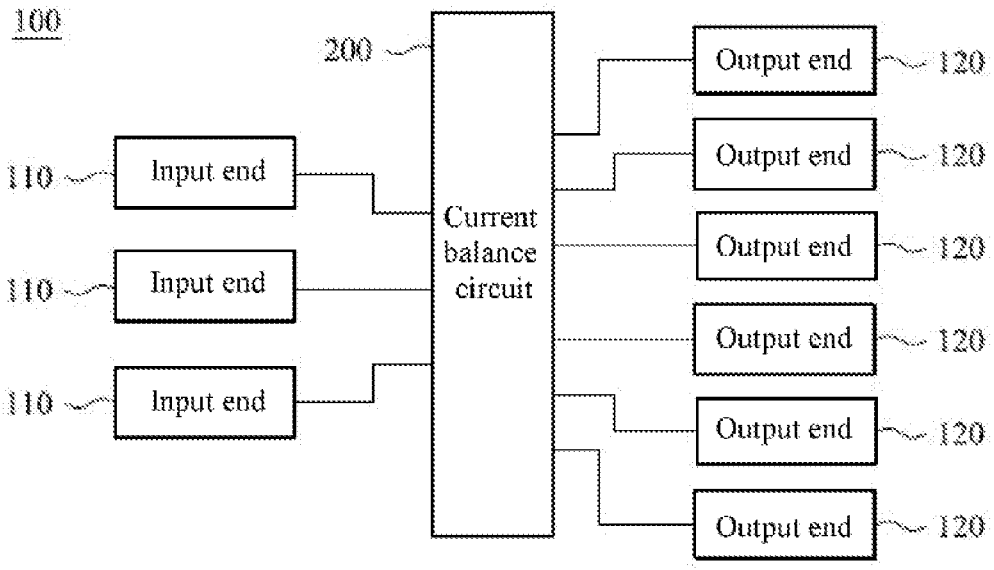
FIG. 1 is a schematic view of a current distribution device according to an embodiment.

FIG. 1 is a schematic view of a current distribution device 100 according to some embodiments of the disclosure. In one embodiment, as shown in FIG. 1, the current distribution device 100 comprises a plurality of input ends 110, a plurality of output ends 120 and a current balance circuit 200, wherein the plurality of input ends 110 is coupled to one end of the current balance circuit 200, and the other end of the current balance circuit 200 is coupled to the plurality of output ends 120.

In one embodiment, the plurality of input ends 110 is configured to receive a plurality of voltages from a same voltage source, and transmit a plurality of currents equivalent to the plurality of voltages to the current balance circuit 200. The current balance circuit 200 distributes a plurality of corresponding output currents to the plurality of output ends 120 according to a plurality of received currents. In one embodiment, the current balance circuit 200 is arranged on a plurality of channels having different impedances, and is configured to adjust a magnitude of a current passing through the channel.

Figure 2:
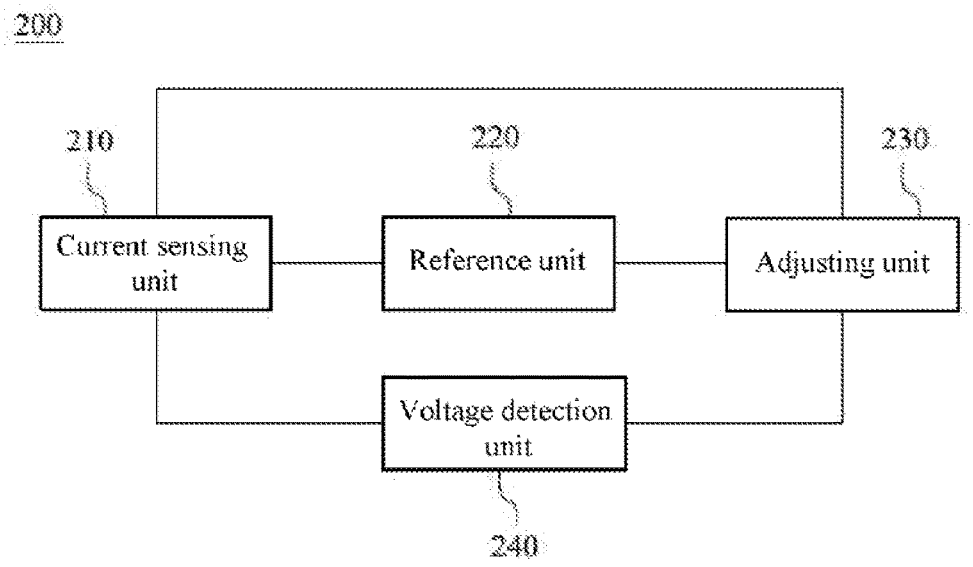
FIG. 2 is a schematic view of a current balance circuit in FIG. 1 according to an embodiment.

FIG. 2 is a schematic view of the current balance circuit 200 in FIG. 1 according to some embodiments of the disclosure.

In one embodiment, the current balance circuit 200 comprises a current sensing unit 210, a reference unit 220 and an adjusting unit 230, wherein the current sensing unit 210 is coupled to the reference unit 220 and the adjusting unit 230, and the reference unit 220 is further coupled to the adjusting unit 230.

In another embodiment, in order to prevent overheating of a circuit (such as a transistor), as shown in FIG. 2, the current balance circuit 200 comprises the current sensing unit 210, the reference unit 220 and the adjusting unit 230. In one embodiment, the current balance circuit 200 further comprises a voltage detection unit 240. In one embodiment, the current sensing unit 210 is coupled to the reference unit 220, the adjusting unit 230 and the voltage detection unit 240, the reference unit 220 is further coupled to the adjusting unit 230, and the voltage detection unit 240 is further coupled to the adjusting unit 230.

Figure 3:
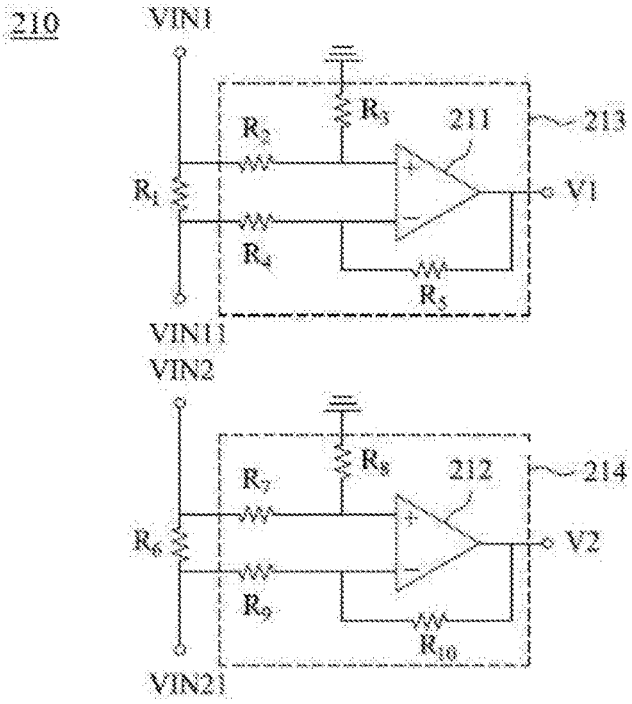
FIG. 3 is a circuit diagram of a current sensing unit in FIG. 2 according to an embodiment.

In one embodiment, the current sensing unit 210 is configured to receive a plurality of input currents from the plurality of input ends 110, and the plurality of input currents is flowed through a plurality of channels having different impedances. The current sensing unit 210 is also configured to generate a plurality of input voltages corresponding to the plurality of input currents. In other words, the current sensing unit 210 is configured to sense magnitudes of the plurality of input currents input to the current balance circuit 200, and represents the plurality of input currents by the plurality of corresponding input voltages. In one embodiment, a circuit of the current sensing unit 210 is configured as shown in FIG. 3, and the circuit of the current sensing unit 210 is illustrated in detail with FIG. 3 as an example.

Figure 4:
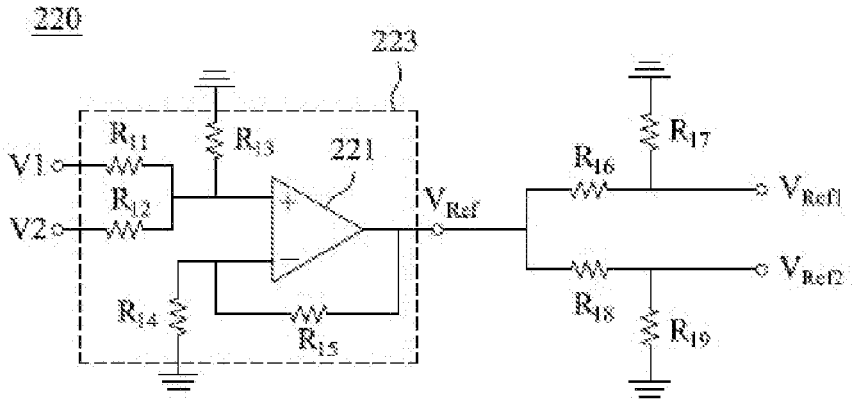
FIG. 4 is a circuit diagram of a reference unit in FIG. 2 according to an embodiment.

In one embodiment, the reference unit 220 is configured to distribute a plurality of setting voltages corresponding to the plurality of output ends 120 according to the plurality of input voltages and an output current ratio of the plurality of output ends 120 calculated by the current sensing unit 210. In detail, the setting voltage is calculated according to the different maximum allowable current of each channel and the output current ratio. In one embodiment, a circuit of the reference unit 220 is configured as shown in FIG. 4, and the circuit is illustrated in detail with FIG. 4 as an example.

Figure 5:
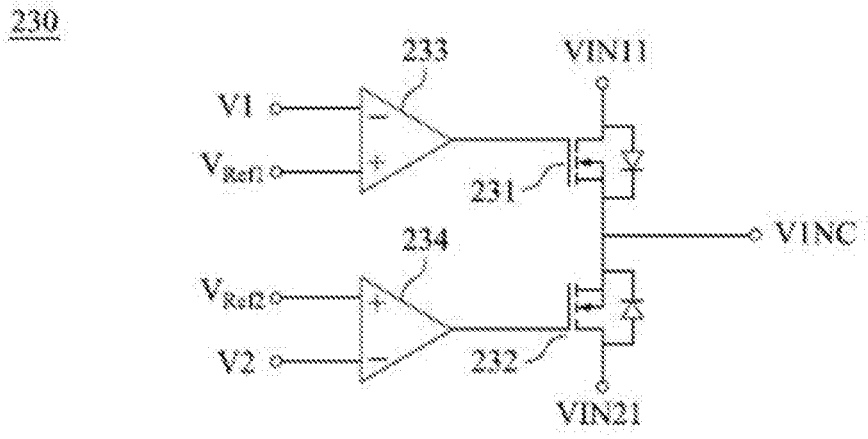
FIG. 5 is a circuit diagram of an adjusting unit in FIG. 2 according to an embodiment.

In one embodiment, the adjusting unit 230 is configured to adjust the plurality of input currents from the plurality of input ends 110 according to the plurality of setting voltages from the reference unit 220 and the plurality of input voltages from the current sensing unit 210, and generate a plurality of output currents to the plurality of output ends 120. In one embodiment, the adjusting unit 230 comprises a plurality of linear switches. The adjusting unit 230 is configured to control an opening degree of the plurality of linear switches according to the plurality of setting voltages from the reference unit 220 and the plurality of input voltages, and adjust the plurality of input currents according to the opening degree of the plurality of linear switches to generate the plurality of output currents. In one embodiment, a circuit of the adjusting unit 230 is configured as shown in FIG. 5, and the circuit is illustrated in detail with FIG. 5 as an example.

Figure 6:
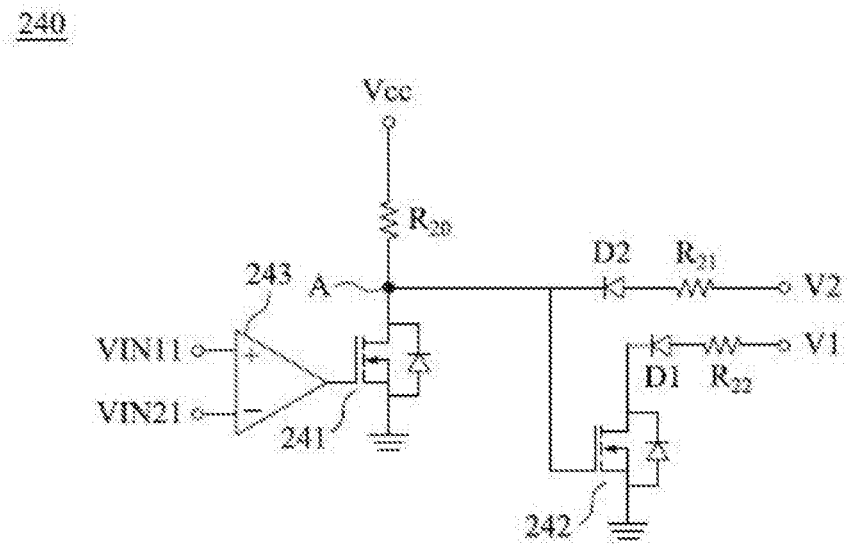
FIG. 6 is a circuit diagram of a voltage detection unit in FIG. 2 according to an embodiment.

In one embodiment, the voltage detection unit 240 is configured to control the plurality of input voltages from the current sensing unit 210 to prevent the plurality of input voltages from exceeding a critical value, thereby causing the temperature of the adjusting unit 230 to be too high. In one embodiment, the critical value is adjusted according to temperature coefficients of the plurality of linear switches in the adjusting unit 230. In one embodiment, a circuit of the voltage detection unit 240 is configured as shown in FIG. 6, and the circuit is illustrated in detail with FIG. 6 as an example.

In general, the plurality of input currents from the plurality of input ends 110 is input to the current sensing unit 210 to determinate magnitudes of the plurality of input currents, which are equivalent to the plurality of input voltages, then the reference unit 220 generates the plurality of wanted setting voltages according to the plurality of input voltages and the output current ratio corresponding to the plurality of output ends 120, the adjusting unit 230 adjusts the plurality of linear switches in the adjusting unit 230 according to the plurality of input voltages and the plurality of setting voltages to adjust the input current and accordingly generate the output current to the plurality of output ends 120, and the voltage detection unit 240 controls the linear switch in the adjusting unit 230 not to exceed a load.

In one embodiment, FIG. 3, FIG. 4, FIG. 5 and FIG. 6 are illustrated with that the current distribution device 100 has two input ends 110 and two output ends 120 as an example, the current balance circuit 200 is configured according to different numbers of the input ends 110 and the output ends 120 in the current distribution device 100 to achieve a current distribution. For clarity, an input end 111 (not shown) and an input end 112 (not shown) respectively represent the two input ends 110, and an output end 121 (not shown) and an output end 122 (not shown) respectively represent the two output ends 120.

FIG. 3 is a circuit diagram of the current sensing unit 210 in FIG. 2 according to some embodiments of the disclosure. In one embodiment, as shown in FIG. 3, the current sensing unit 210 comprises a resistor R1, a resistor R6, an amplifier circuit 213 and an amplifier circuit 214, wherein a first end of the resistor R1 is coupled to a positive input end of the amplifier circuit 213, a second end of the resistor R1 is coupled to an inverted input end of the amplifier circuit 213, a first end of the resistor R6 is coupled to a positive input end of the amplifier circuit 214, and a second end of the resistor R6 is coupled to an inverted input end of the amplifier circuit 214. As shown in FIG. 3, the first end of the resistor R1 receives a voltage VIN1 from the input end 111 (not shown), the second end of the resistor R1 receives a voltage VIN11, the first end of the resistor R6 receives a voltage VIN2 from the input end 112 (not shown), the second end of the resistor R6 receives a voltage VIN21, a value of a current flowing through the resistor R1 is obtained by dividing a difference between a voltage value of the voltage VIN1 and a voltage value of the voltage VIN11 by a resistance value of the resistor R1, and a value of a current flowing through the resistor R6 is obtained by dividing a difference between a voltage value of the voltage VIN2 and a voltage value of the voltage VIN21 by a resistance value of the resistor R6.

In one embodiment, the amplifier circuit 213 comprises an amplifier 211, a resistor R2, a resistor R3, a resistor R4 and a resistor R5, wherein a first end of the resistor R2 is coupled to the first end of the resistor R1, a second end of the resistor R2 is coupled to a second end of the resistor R3 and a positive input end of the amplifier 211, a first end of the resistor R3 is grounded, the second end of the resistor R3 is coupled to the positive input end of the amplifier 211, a first end of the resistor R4 is coupled to the second end of the resistor R1, a second end of the resistor R4 is coupled to a first end of the resistor R5 and an inverted input end of the amplifier 211, the first end of the resistor R5 is coupled to the inverted input end of the amplifier 211, and a second end of the resistor R5 is coupled to an output end of the amplifier 211. In one embodiment, the amplifier circuit 214 and the amplifier circuit 213 are similar in function and component, the resistor R1 and the resistor R6 are the same in resistance value, the resistor R2 and a resistor R7 are the same in resistance value, the resistor R3 and a resistor R8 are the same in resistance value, the resistor R4 and a resistor R9 are the same in resistance value, and the resistor R5 and a resistor R10 are the same in resistance value.

In one embodiment, the amplifier circuits 213 and 214 are differential amplifiers, and any other electronic components capable of being configured to amplify the input current is within in a protection scope of the disclosure.

In one embodiment, the current sensing unit 210 is provided with the plurality of resistors R1 to R10 with different resistance values, so that an equivalent current of an input voltage V1 is 100 times the input current from the input end 111, and an equivalent current of an input voltage V2 is 100 times the input current from the input end 112. The amplification factor is included but not limited to 100 times.

In one embodiment, the reason for amplifying the input current by 100 times lies in that a precision resistor (such as the resistors R1 and R6) used in a common circuit is too small in resistance value, so it is needed to amplify the input current by 100 times so that the equivalent input voltages V1 and V2 of the two input ends 111 and 112 are easy to distinguish.

FIG. 4 is a circuit diagram of the reference unit 220 in FIG. 2 according to some embodiments of the disclosure. In one embodiment, as shown in FIG. 4, the reference unit 220 comprises an adder circuit 223 and resistors R16, R17, R18 and R19, wherein a first end of the resistor R16 is coupled to the adder circuit 223, a second end of the resistor R16 is coupled to a first end of the resistor R17, a second end of the resistor R17 is grounded, a first end of the resistor R18 is coupled to the adder circuit 223, a second end of the resistor R18 is coupled to a first end of the resistor R19, and a second end of the resistor R19 is grounded.

In one embodiment, the reference unit 220 adds the input voltages V1 and V2 from the current sensing unit 210 by the adder circuit 223, so that an equivalent voltage V1+V2 (namely a setting voltage VRef) of a sum of the input currents is obtained, and resistance values of the resistors R16, R17, R18 and R19 are configured according to the output current ratio of the output end 120, so that an output current (which is equivalent to setting voltages VRef1 and VRef2) is obtained. In one embodiment, if the ratio of the output currents of the output ends 121 and 122 is 1:1, a resistant value of the resistor R16 and a resistance value of the resistor R17 are the same, and a resistant value of the resistor R18 and a resistance value of the resistor R19 are the same, so that the setting voltages VRef1 and VRef2 are the same.

In one embodiment, the adder circuit 223 comprises an amplifier 221 and resistors R11, R12, R13, R14 and R15, wherein a second end of the resistor R11 is coupled to a second end of the resistor R12, a first end of the resistor R13, the second end of the resistor R11 and the second end of the resistor R12 are coupled to a positive input end of the amplifier 221, a second end of the resistor R13 is grounded, a first end of the resistor R14 is grounded, a second end of the resistor R14 is coupled to a first end of the resistor R15 and an inverted input end of the amplifier 221, and a second end of the resistor R15 is coupled to an output end of the amplifier 221.

FIG. 5 is a circuit diagram of the adjusting unit 230 in FIG. 2 according to some embodiments of the disclosure. In one embodiment, as shown in FIG. 5, the adjusting unit 230 comprises an amplifier circuit 233, an amplifier circuit 234, a transistor 231 and a transistor 232, wherein an output end of the amplifier circuit 233 is coupled to a gate of the transistor 231, and an output end of the amplifier circuit 234 is coupled to a gate of the transistor 232.

In one embodiment, as shown in FIG. 5, a positive input end of the amplifier circuit 233 receives the setting voltage VRef1, an inverted input end of the amplifier circuit 233 receives the input voltage V1, and an output end of the amplifier circuit 233 outputs a difference between the setting voltage VRef1 and the input voltage V1. A positive input end of the amplifier circuit 234 receives the setting voltage VRef2, an inverted input end of the amplifier circuit 234 receives the input voltage V2, and an output end of the amplifier circuit 234 outputs a difference between the setting voltage VRef2 and the input voltage V2. A source of the transistor 231 receives the voltage VIN11, a drain of the transistor 231 outputs a voltage VINC, a source of the transistor 232 receives the voltage VIN21, and a drain of the transistor 232 outputs the voltage VINC, wherein the voltage VINC is equivalent to a sum of the output currents output to the output end 120.

In one embodiment, due to the positive input end and the inverted input end of the amplifier circuit 233 being at virtual ground, a voltage (namely the input voltage V1) of the inverted input end of the amplifier circuit 233 approaches a voltage (namely the setting voltage VRef1) of the positive input end all the time, similarly, a voltage (namely the input voltage V2) of the inverted input end of the amplifier circuit 234 approaches a voltage (namely the setting voltage VRef2) of the positive input end all the time, whereby, the output current is controlled to approach a wanted voltage of the output end 120, namely, the setting voltages VRef1 and VRef2.

In one embodiment, the adjusting unit 230 adjusts conduction degrees of the transistor 231 and the transistor 232 based on output voltages of the amplifier circuit 233 and the amplifier circuit 234 to control a magnitude of the output current by changing an equivalent impedance. In one embodiment, the transistor 231 and the transistor 232 include, but are not limited to, N-type metal oxide semiconductor field effect transistor (NMOSFET).

FIG. 6 is a circuit diagram of the voltage detection unit 240 in FIG. 2 according to some embodiments of the disclosure. In one embodiment, as shown in FIG. 6, the voltage detection unit 240 comprises an amplifier circuit 243, a transistor 241, a transistor 242, a switch D1, a switch D2 and resistors R20, R21 and R22, wherein an output end of the amplifier circuit 243 is coupled to a gate of the transistor 241, a source of the transistor 241 is grounded, a drain of the transistor 241 is coupled to a node A, a second end of the resistor R20 is coupled to the node A, a second end of the switch D2 is coupled to the node A and a gate of the transistor 242, a first end of the switch D2 is coupled to a first end of the resistor R21, a source of the transistor 242 is grounded, a drain of the transistor 242 is coupled to a second end of the switch D1, and a first end of the switch D1 is coupled to a first end of the resistor R22.

In one embodiment, the switches D1 and D2 are diodes, but are not to limit the scope of the disclosure.

In one embodiment, as shown in FIG. 6, a positive input end of the amplifier circuit 243 receives the voltage VIN11, an inverted input end of the amplifier circuit 243 receives the voltage VIN21, and an output end of the amplifier circuit 243 outputs a difference between the voltage VIN11 and the voltage VIN21, and feeds the difference into the gate of the transistor 241. A first end of the resistor R20 receives a control voltage Vcc to make the node A at a high voltage value when the transistor 241 is on. The voltage detection unit 240 outputs the input voltage V2 through a second end of the resistor R21, and outputs the input voltage V1 through a second end of the resistor R22.

In one embodiment, when the voltage VIN11 is greater than the voltage VIN21, the transistor 241 is on, and as a result, a voltage of the node A is pulled down to 0 V, the switch D2 is on, and whereby a voltage value of the input voltage V2 is pulled down; when the voltage VIN11 is less than the voltage VIN21, the transistor 241 is turned off, the transistor 242 is on through the control voltage Vcc, the switch D1 is on, and thereby a voltage value of the input voltage V1 is pulled down. In one embodiment, a voltage value of the control voltage Vcc is 12V.

In summary, the magnitude of the current on each channel is distributed according to the output current ratio of the plurality of output ends 120 and the maximum current load on each channel to prevent the channels from being subjected to an overload current.

Although the disclosure is described with reference to the above embodiments, the embodiments are not intended to limit the disclosure. Any person of ordinary skill in the art may make variations and modifications without departing from the spirit and scope of the disclosure. Therefore, the protection scope of the disclosure should be subject to the appended claims.

What is claimed is:

1. A current balance circuit, comprising:

a current sensing unit, configured to receive a plurality of input currents flowing through a plurality of channels having different impedances, and generate a plurality of corresponding input voltages according to the plurality of input currents;

a reference unit, coupled to the current sensing unit, and configured to distribute a plurality of setting voltages corresponding to a plurality of output ends according to an output current ratio related to the plurality of output ends and the plurality of input voltages; and an adjusting unit, coupled to the current sensing unit and the reference unit, and configured to adjust the plurality of input currents according to the plurality of setting voltages and the plurality of input voltages, and generate a plurality of output currents to the plurality of output ends.

2. The current balance circuit according to claim 1, wherein the adjusting unit is further configured to control an opening degree of a plurality of linear switches according to the plurality of setting voltages and the plurality of input voltages, and configured to adjust the plurality of input currents according to the opening degree of the plurality of linear switches to generate the plurality of output currents.

3. The current balance circuit according to claim 1, wherein the current sensing unit comprises:

a first resistor, a first end of the first resistor configured to receive a first input current of the plurality of input currents;

a first amplifier circuit, configured to amplify a voltage difference of two ends of the first resistor to generate a first input voltage of the plurality of input voltages;

a second resistor, a first end of the second resistor being configured to receive a second input current of the plurality of input currents; and a second amplifier circuit, configured to amplify a voltage difference of two ends of the second resistor to generate a second input voltage of the plurality of input voltages.

4. The current balance circuit according to claim 1, wherein the reference unit comprises:

an adder circuit, adding the plurality of input voltages;

a first resistor, a first end of the first resistor being coupled to the adder circuit;

a second resistor, a first end of the second resistor being coupled to a second end of the first resistor and a first setting voltage of the plurality of setting voltages, and a second end of the second resistor being grounded;

a third resistor, a first end of the third resistor being coupled to the adder circuit; and a fourth resistor, a first end of the fourth resistor being coupled to a second end of the third resistor and a second setting voltage of the plurality of setting voltages, and a second end of the fourth resistor being grounded.

5. The current balance circuit according to claim 4, wherein a ratio of resistance values of the first resistor and of the second resistor and a ratio of resistance values of the third resistor and of the fourth resistor are related to the output current ratio.

6. The current balance circuit according to claim 1, wherein the adjusting unit comprises:

a first amplifier circuit, a positive input end of the first amplifier circuit being coupled to a first input voltage of the plurality of input voltages, and an inverted input end of the first amplifier circuit being coupled to a first setting voltage of the plurality of setting voltages;

a first transistor, a source of the first transistor receiving a first input current of the plurality of input currents, a gate of the first transistor being coupled to an output end of the first amplifier circuit, and a drain of the first transistor being configured to output a first output current of the plurality of output currents;

a second amplifier circuit, a positive input end of the second amplifier circuit being coupled to a second input voltage of the plurality of input voltages, and an inverted input end of the second amplifier circuit being coupled to a second setting voltage of the plurality of setting voltages; and a second transistor, a source of the second transistor being configured to receive a second input current of the plurality of input currents, a gate of the second transistor being coupled to an output end of the second amplifier circuit, and a drain of the second transistor being configured to output a second output current of the plurality of output currents.

7. The current balance circuit according to claim 6, wherein the first input voltage approaches the first setting voltage when the positive input end and the inverted input end of the first amplifier circuit achieve balance, and the second input voltage approaches the second setting voltage when the positive input end and the inverted input end of the second amplifier circuit achieve balance.

8. The current balance circuit according to claim 1, further comprising:

a voltage detection unit, coupled to the adjusting unit and the current sensing unit, and configured to control the plurality of input voltages from the current sensing unit to prevent the plurality of input voltages from exceeding a critical value.

9. The current balance circuit according to claim 8, wherein the voltage detection unit comprises:

an amplifier circuit, a positive input end of the amplifier circuit being configured to receive a first input current of the plurality of input currents, and an inverted input end of the amplifier circuit being configured to receive a second input current of the plurality of input currents;

a first transistor, a source of the first transistor being grounded, a gate of the first transistor being coupled to an output end of the amplifier circuit, and a drain of the first transistor being coupled to an operating voltage;

a first switch, a first end of the first switch being coupled to a first input voltage of the plurality of input voltages, and a second end of the first switch being coupled to the drain of the first transistor;

a second transistor, a source of the second transistor being grounded, and a gate of the second transistor being coupled to the drain of the first transistor and a second end of the first switch; and a second switch, a first end of the second switch being coupled to a second input voltage of the plurality of input voltages, and a second end of the second switch being coupled to a drain of the second transistor.

10. The current balance circuit according to claim 9, wherein the second switch is configured to be on when the first input current is greater than the second input current to pull down the second input voltage, and the first switch is configured to be on when the first input current is less than the second input current to pull down the first input voltage.

* * * * *